US007028522B2

(12) United States Patent
Kim et al.

(10) Patent No.: US 7,028,522 B2
(45) Date of Patent: Apr. 18, 2006

(54) ELECTRIC HEATING TYPE ROLLING DEVICE

(75) Inventors: Stanislav K Kim, Moscow Region (RU); Oleg A Troitsky, Moscow Region (RU); Won-Guk Jee, Seongnam-si (KR)

(73) Assignee: Kyong In Special Metal Co., Ltd., Incheon (KR)

( * ) Notice: Subject to any disclaimer, the term of this patent is extended or adjusted under 35 U.S.C. 154(b) by 318 days.

(21) Appl. No.: 10/615,830

(22) Filed: Jul. 10, 2003

(65) Prior Publication Data

US 2004/0231387 A1 Nov. 25, 2004

(30) Foreign Application Priority Data

May 23, 2003 (KR) ..... 10-2003-0032740

(51) Int. Cl.
*B21B 27/06* (2006.01)

(52) U.S. Cl. ..... 72/202; 72/200; 72/342.1; 219/152

(58) Field of Classification Search ..... 72/200, 72/202, 364, 201, 69, 342.1; 219/84, 119, 219/152; 266/104
See application file for complete search history.

(56) References Cited

U.S. PATENT DOCUMENTS 3,988,913 A * 11/1976 Metcalfe et al. ..... 72/69
3,988,914 A * 11/1976 Metcalfe et al. ..... 72/69
5,042,281 A * 8/1991 Metcalfe ..... 72/200
5,515,705 A * 5/1996 Weldon et al. ..... 72/19.1
5,823,037 A 10/1998 Kim et al.

FOREIGN PATENT DOCUMENTS

| | | |
|---|---|---|
| JP | 61-245911 | 11/1986 |
| JP | 05-305324 | 11/1993 |
| JP | 06047405 A * | 2/1994 |
| JP | 10-180317 | 7/1998 |

* cited by examiner

*Primary Examiner*—Dmitry Suhol
(74) *Attorney, Agent, or Firm*—Pillsbury Winthrop Shaw Pittman LLP

(57) ABSTRACT

An electric heating type rolling device comprises work rolls for rolling a metal strip, a power supply for generating a pulse current, a pair of upstream contact members which are disposed in a location before the metal strip passes through the work rolls, and a pair of downstream contact members which are disposed opposite to the upstream contact members in a location after the metal strip has been rolled by the work rolls and passed thereby. The contact members are electrically connected to the power supply. Each contact member includes a first contact portion contacting the metal strip, a flat portion which is extended from the first contact portion toward the work rolls while being spaced apart from the metal strip, and a second contact portion which is extended from the flat portion to contact the metal strip.

6 Claims, 6 Drawing Sheets

ELECTRIC HEATING TYPE ROLLING DEVICE

FIELD OF THE INVENTION

The present invention relates to a rolling device, and particularly to an electric heating type rolling device which improves reduction ratio and prevents overheating of a metal strip and resultant surface oxidization thereof by heating the same using a pulse current during a continuous rolling process.

BACKGROUND OF THE INVENTION

Generally, cold rolling refers to compressing and squeezing metal strips between work rolls at room temperature, and hot rolling refers to compressing and squeezing metal strips while applying heat.

The advantages of cold rolling are good dimensional accuracy and surface finish. However, cold rolling necessarily requires an annealing process, so the entire rolling process time is lengthened and the productivity is lowered.

In hot rolling, a metal strip is heated in a heating furnace, and is then fed to a rolling device. It is extremely important to heat the metal strip to a specified temperature before rolling. When the heating temperature is much lower than a specified one, many difficulties may occur such that it is hard to carry out rolling, excessive loads are imposed on the rolling device, and desirable properties cannot be obtained for the rolled strip.

The metal strip is cooled by heat radiation while the metal strip is being transferred to the rolling device after being discharged from the heating furnace. The metal strip is further cooled when it contacts work rolls just before rolling. Therefore, the metal strip is heated to a specified temperature which is determined by taking into account such decreases in temperature. However, if an excessively high temperature is set as the heating temperature, there is an increase in oxidization of the metal strip and an increase in energy costs is inevitable.

Under these circumstances, it is advisable to heat metal strips as close as possible to work rolls. For such a purpose, it is conceivable to employ a high-frequency induction heating method and an electric heating method.

However, a high-frequency induction heating device is complicated, expensive and high power-consumptive.

An example of an electric heating type rolling device is disclosed in Japanese patent publication No.1998-180317, which will be described with reference to FIG. 1.

As shown in the drawing, slip rings 12 and 13, which are electrically connected to a power supply 14, are respectively provided at each end of upper and lower work rolls 10. Constant current is supplied to the work rolls 10 and a metal strip S from the power supply 14, and the metal strip S is heated to a predetermined temperature due to its own electric resistance.

However, the prior art electric heating type rolling device has a problem of consuming excessive power. When a steel strip having a width of 100 mm and a thickness of 2 mm, i.e. a cross-sectional area of 2 $cm^2$, is rolled to have a thickness of 0.25~0.3 mm by electric-heating, a current density of about $10^4$ $A/cm^2$ is required. In case of applying constant current, the current strength reaches to 20000 A, multiplying the current density by the cross-sectional area of the strip to be rolled.

Further to such an excessive power-consumption, the steel strip is heated to a temperature ranging from 400° C. to 500° C., which causes oxidization and discoloration on the strip surface.

Also, because the work rolls are included in the electric circuit, the life of work rolls may be shortened due to electric corrosion, and a cooling device for preventing the work rolls from being damaged by heat transfer from the steel strip is additionally required.

SUMMARY OF THE INVENTION

It is an object of the present invention to overcome the problems in the prior art and provide an electric heating type rolling device which improves reduction ratio and prevents overheating of a metal strip and resultant surface oxidization thereof by heating the same using a pulse current during a continuous rolling process.

In order to achieve the above object, the present invention provides an electric heating type rolling device comprising at least one pair of work rolls for rolling a metal strip while contacting the metal strip; a power supply for generating a pulse current; and first and second conductive electrode means which are electrically connected to the power supply for applying the pulse current to the metal strip. The first conductive electrode means is disposed in a location before the metal strip passes through the work rolls, and the second conductive electrode means is disposed opposite to the first conductive electrode means in a location after the metal strip has been rolled by the work rolls and passed thereby.

According to a preferred embodiment of the present invention, the first and second conductive electrode means are respectively implemented as a pair of contact members which are disposed contactingly above and below the metal strip. Each contact member includes a first contact portion contacting the metal strip, a flat portion which is extended from an end of the first contact portion toward the work rolls while being spaced apart from the metal strip, and a second contact portion which is extended from an end of the flat portion to contact the metal strip.

The second contact portion is forked into several pieces along the transverse direction of the metal strip, and the contact members are provided with an elastic member for biasing the second contact portion toward the metal strip to contact the metal strip with no gap.

According to another preferred embodiment of the present invention, the first and second conductive electrode means are respectively implemented as a pair of electrode rolls which are disposed contactingly above and below the metal strip.

BRIEF DESCRIPTION OF DRAWINGS

The above object and features of the present invention will become more apparent from the following description of the preferred embodiments given in conjunction with the accompanying drawings.

DETAILED DESCRIPTION OF THE PRESENT INVENTION

Preferred embodiments of the present invention will now be described with reference to the accompanying drawings. Since the basic structure and rolling method of the electric heating type rolling device of the present invention are same as those of the prior art, a detailed explanation thereof will be omitted.

Figure 1:
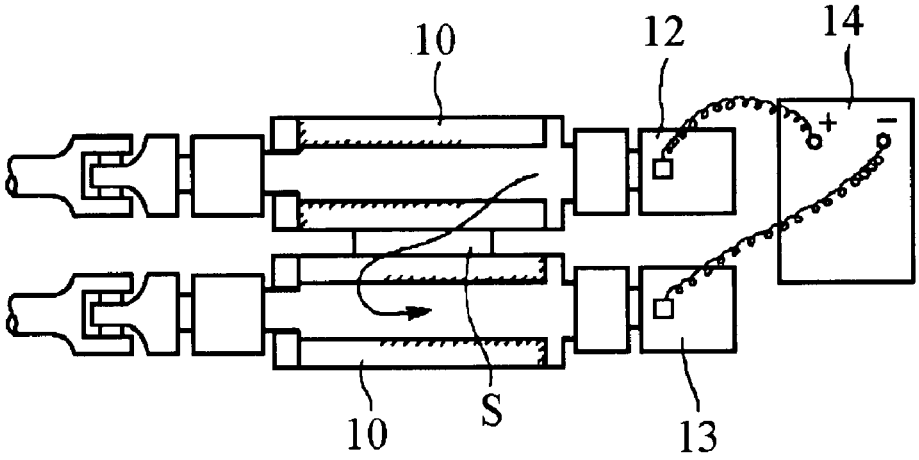
Fig. 1 (Prior Art)
FIG. 1 is a side view of a conventional electric heating type rolling device.
Figure 2:
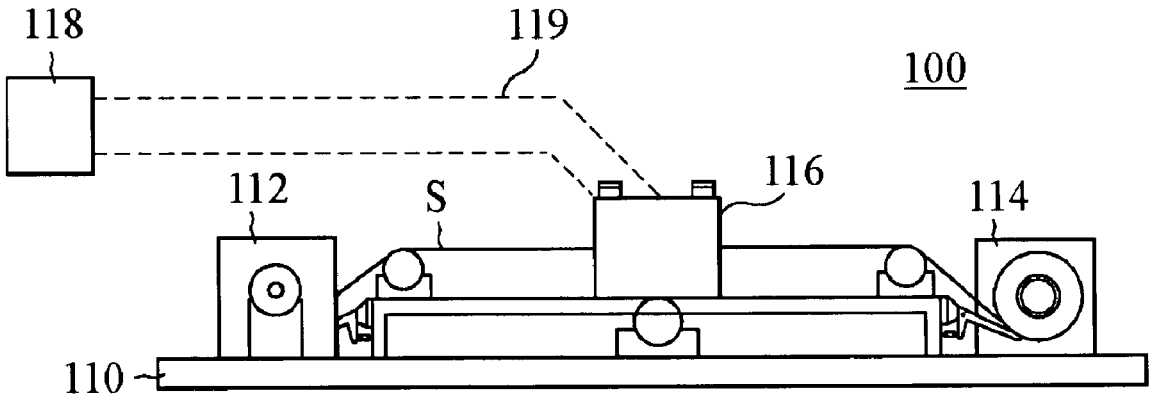
FIG. 2 is a front view showing an electric heating type rolling device in accordance with a first embodiment of the present invention.
Figure 3:
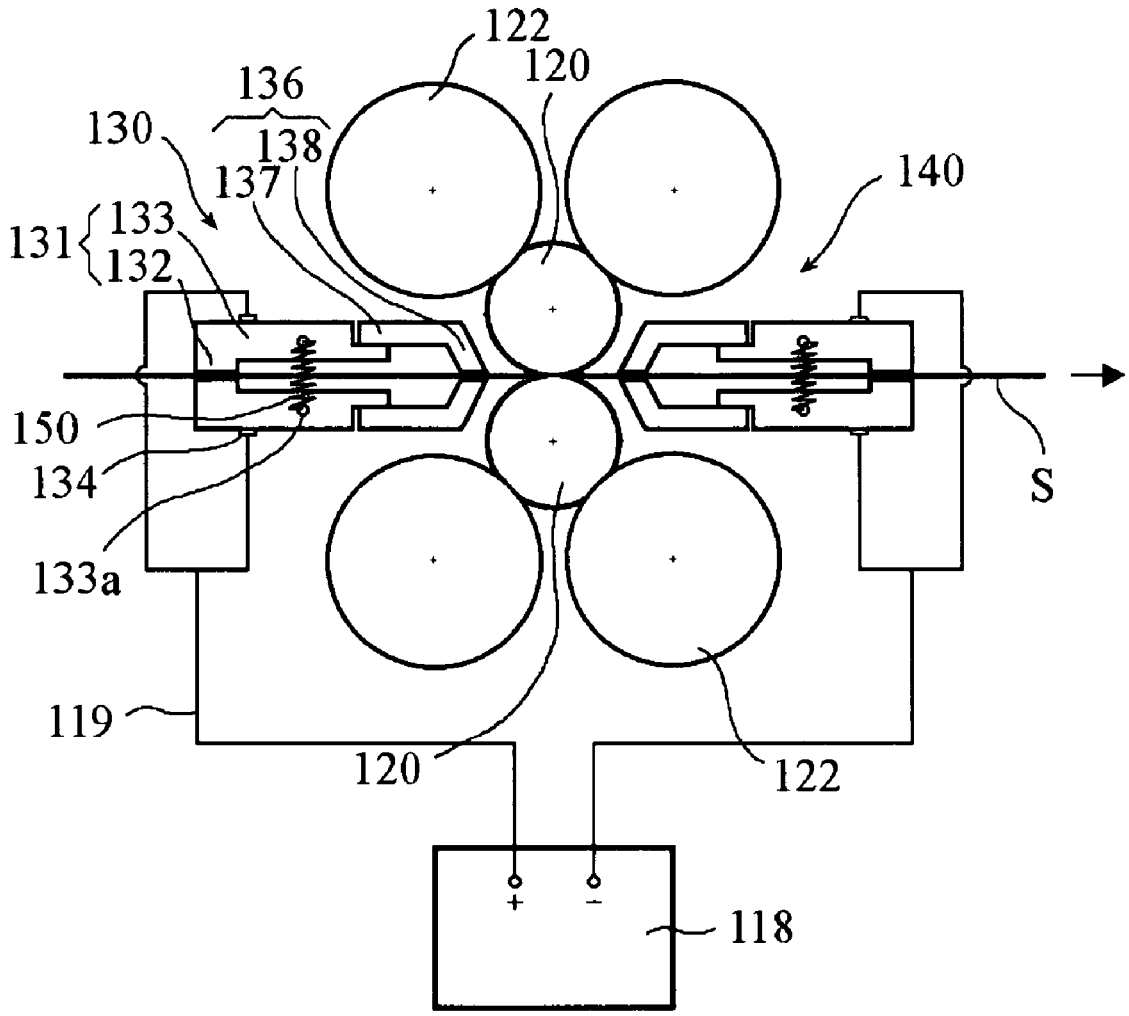
FIG. 3 shows a schematic for an inner structure of a roll stand of the electric heating type rolling device in accordance with the first embodiment of the present invention.

FIG. 2 is a front view showing an electric heating type rolling device in accordance with a first embodiment of the present invention, and FIG. 3 shows schematically an inner structure of a roll stand of the electric heating type rolling device depicted in FIG. 2.

As shown in the drawings, an electric heating type rolling device 100 according to a first embodiment of the present invention comprises a base 110, front and rear strip reels 112 and 114 mounted on the base 110 for feeding a metal strip S, a roll stand 116 mounted between the strip reels 112 and 114, and a power supply 118 for generating a pulse current and supplying the same to the roll stand 116.

The roll stand 116 includes at least two pairs of support rolls 122 rotatably mounted, and at least one pair of work rolls 120 rotatably mounted for compressing and squeezing the metal strip S. One pair of support rolls 122 are disposed above the metal strip S, and the other pair of support rolls 122 are below the metal strip S. Each work roll 120 is disposed between each pair of support rolls 122, and made from a material having a high heat-resisting property and conductivity.

The metal strip S may be moved from the front reel 112 to the rear reel 114, but may also be moved in the reverse direction, from the rear reel 114 to the front reel 112. Preferred embodiments of the present invention will now be described under the condition of moving the metal strip S from the front reel 112 to the rear reel 114.

Hereinafter, a location between the front reel 112 and the work rolls 120, i.e. before the metal strip S passes through the work rolls 120, is defined as "upstream". And, a location between the work rolls 120 and the rear reel 114, i.e. after the metal strip S has been rolled by the work rolls 120 and passed thereby, is defined as "downstream".

Referring to FIG. 3, the inventive electric heating type rolling device 100 includes first and second conductive electrode means, which are respectively implemented as a pair of "upstream" contact members 130 and a pair of "downstream" contact members 140. The contact members 130 and 140 are provided adjacent to the upper and lower work rolls 120.

The "upstream" contact members 130 contact the upper and lower surfaces of the metal strip S with a certain contact area, and are electrically connected to a positive pole of the power supply 118 by means of cables 119.

Figure 4:
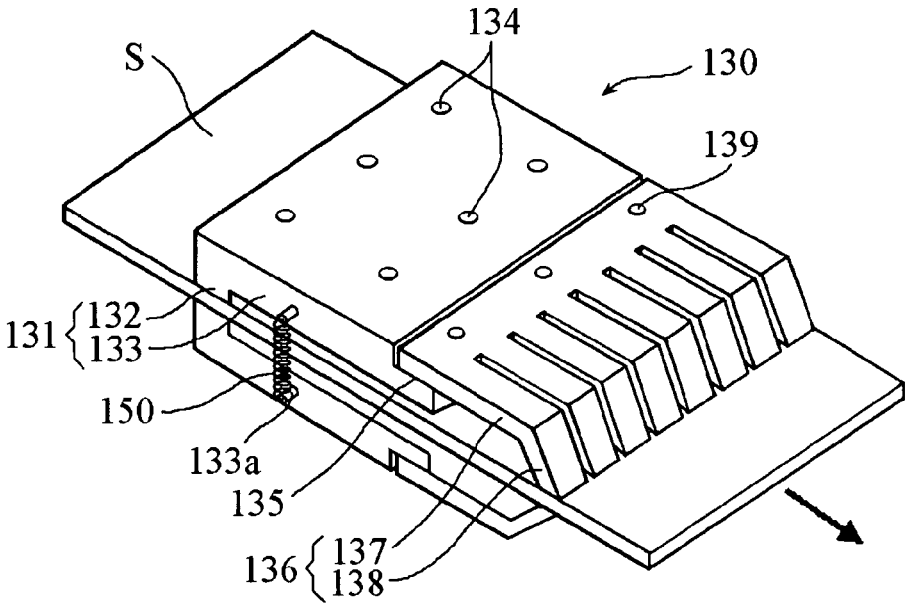
FIG. 4 is a perspective view showing conductive electrode means of the electric heating type rolling device in accordance with the first embodiment of the present invention.

Describing more detail with reference to FIG. 4, an upper contact member disposed above the metal strip S includes a base part 131 and a current-applying part 136 coupled to the base part 131.

The base part 131 includes a first contact portion 132 contacting the upper surface of the metal strip S and extended upwardly, and a first flat portion 133 extended horizontally from the top end of the first contact portion 132 and spaced apart from the metal strip S at a predetermined distance. Several terminals 134 for connecting the cables 119 are provided at the upper surface of the first flat portion 133.

A stepped portion 135 is formed at the end of the first flat portion 133, on which one end of the current-applying part 136 is seated.

The current-applying part 136 includes a second flat portion 137 extended horizontally and spaced apart from the metal strip S at a predetermined distance, and a second contact portion 138 extended downwardly from the end of the second flat portion 137 and contacting the metal strip S.

The second flat portion 137 of the current-applying part 136 is fitted on the stepped portion 135 of the base part 131. To divide the contact member 130 into the base part 131 and the current-applying part 136 is for manufacturing convenience. The contact member 130 may be formed as a one-piece body. And, such a contact member 130 has the same width as metal strip S.

The second contact portion 138 of the current-applying portion 136 should be flat over the entire contact surface and disposed parallel with the metal strip S for a uniform contact thereto with no gap. However, it is very difficult to meet this requirement if the second contact portion 138 is formed in a body. To solve this problem, the second contact portion 138 is forked into several pieces along the transverse direction of the metal strip S. Therefore, although the second contact portion 138 is not flat nor disposed parallel with the metal strip S, the divided pieces of the second contact portion 138 can be individually adjusted to be in contact with the metal strip S with no gap by physical modification such as bending, etc. This results in enhancement of contact efficiency and electric conductivity between the second contact portion 138 and the metal strip S. Especially, such a second contact portion 138 has more effect as the metal strip S to be rolled becomes broader.

Further, when rolling a relatively broad metal strip S, the pulse current to heat the metal strip S can be sufficiently applied through the terminals 134 which are provided evenly on the first flat portion 133 of the contact member 130.

Preferably, the second contact portion 138 is slanted toward the work rolls 120 at a predetermined obtuse angle with respect to the flat portion 137. This is for minimizing the decrease in surface temperature of the metal strip S while the metal strip S is fed toward the work rolls 120 by shortening the distance between the second contact portion 138 and the work rolls 120.

Also, separation of the flat portions 133 and 137 away from the metal strip S is for reducing the friction between the contact member 130 and the metal strip S and preventing the wear or electric spark therebetween by securing the least contact area necessary to conduct the pulse current.

Preferably, the contact member 130 is made from a material having a high abrasion resistance like graphite or copperplate, etc.

A lower contact member located contactingly under the metal strip S is formed in the same shape as the upper contact member, but disposed symmetrically thereto.

Protrusions 133*a* are formed at the side surfaces of the flat portions of the upper and lower contact members 130. The protrusions 133*a* are vertically aligned with each other. An elastic member 150 such as a spring is supported by the protrusions 133*a* in such a manner that both ends are respectively connected to the protrusions 133*a*. By this elastic member 150, the second contact portions 138 of the upper and lower contact members 130 are biased to contact the metal strip S with no gap. Accordingly, as the second contact portions 138 are worn by the friction with the running metal strip S, the second contact portions 138 are kept in contact with the metal strip S by the elastic member 150. Preferably, a pair of elastic members are symmetrically provided at the both side surfaces of the contact members 130, to equalize the contact force between the second contact portions 138 and the metal strip S over the entire contact area.

The pair of "downstream" contact members 140 are formed in the same shape as the "upstream" contact members 130, but disposed symmetrically thereto such that second contact portions face toward the work rolls 120. The "downstream" contact members 140 are electrically connected to a negative pole of the power supply 118 by means of the cables 119.

The power supply 118, the "upstream" contact members 130, the metal strip S and the "downstream" contact members 140 form a closed-circuit.

The operational effect of the electric heating type rolling device 100 according to the first embodiment of the present invention will now be described.

In state of moving the metal strip S from the front reel 112 to the rear reel 114, the power supply 118 generates a pulse current. The pulse current is supplied to the "upstream" contact members 130 through the cables 119, and then flows through the second contact portions 138, the metal strip S and the "downstream" contact members 140, to heat the metal strip S to a specified rolling temperature by Joule heat.

When a steel strip having a width of 100 mm and a thickness of 2 mm is rolled to have a thickness of 0.25~0.3 mm by an electric-heating, a current density $J_m$ of about $10^4$ A/cm$^2$ is required. When a pulse current is applied, the pulse current is set to have a duration $\tau$ of $10^{-4}$ sec and a frequency F calculated from the following equation (1).

$$F = k\frac{Vm}{\Delta l} \qquad \text{Eq. (1)}$$

Here, $V_m$ means a feeding speed of the steel strip, $\Delta l$ is a deformation length of the steel strip which is compressed by the contact with the upper and lower work rolls 120, and k is a number of pulses applied to the steel strip by each deformation length $\Delta l$, which is set to 2.

For example, when rolling a steel strip having a width of 100 mm and a thickness of 2 mm, i.e. a cross-sectional area B of 2 cm$^2$, at feeding speed $V_m$ of 0.5 m/sec and deformation length $\Delta l$ of $10^{-3}$ m, a frequency F of the pulse current is calculated at $10^3$ Hz from the above equation (1).

By the pulse duration $\tau$ of $10^{-4}$ sec and the above-calculated frequency F of $10^3$ Hz, a ratio Q of a pulse period $T_i$ to the pulse duration $\tau$ is calculated at 10 from the following equation (2).

$$Q = \frac{Ti}{\tau} = \frac{1}{F\tau} \qquad \text{Eq. (2)}$$

Also, the mean value $J_{mean}$ of the strength of the pulse current applied to the steel strip can be calculated from the following equation (3).

$$Jmean = Jm\frac{\tau}{Ti}B = 20000\frac{1}{Q} = \frac{20000}{10} = 2000\ (\mathrm{A}) \qquad \text{Eq. (3)}$$

As known from equation (3), the power consumption in applying the pulse current is a tenth of that in applying the constant current.

Furthermore, since the pulse duration $\tau$ is very short, i.e., $10^{-4}$ sec, although the current density $J_m$ is $10^4$ A/cm$^2$, the surface temperature of the steel strip does not rise so high, experimentally about 250° C. Accordingly, the surface oxidization and discoloration of the steel strip due to overheating can be prevented.

Figure 5:
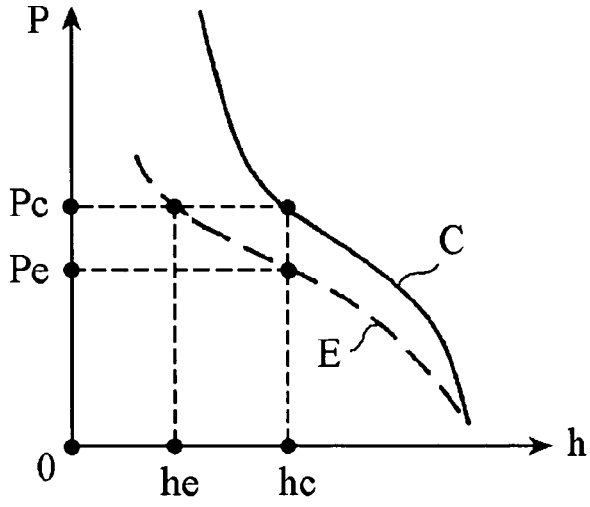
FIG. 5 is a graph plotting pressure of work rolls applied to a metal strip in a prior art cold rolling (curve C) and in the electric heating type rolling device in accordance with the first embodiment of the present invention (curve E) relative to a thickness of the metal strip after being rolled.

FIG. 5 is a graph showing pressure of work rolls applied to a metal strip in a prior art cold rolling (curve C) and in the electric heating type rolling device (curve E) in accordance with the first embodiment of the present invention relative to a thickness of the metal strip after being rolled under the above-mentioned condition.

As shown in the graph, as thickness h of the steel strip after being rolled (hereinafter, target thickness) is smaller, the pressure P of the work rolls applied to the steel strip is larger.

From the curve C showing the cold rolling, when the target thickness h is a value of $h_c$, the pressure P of the work rolls becomes a value of $P_c$. And, when the target thickness h is smaller than the value of $h_c$, the pressure P of the work rolls increases rapidly nonlinearly. So, the value $h_c$ is a minimum target thickness which can be achieved by the cold rolling.

On the contrary, as known from curve E, in the electric heating type rolling device according to the first embodiment of the present invention with the same target thickness ($h=h_c$), the pressure P of the work rolls becomes the value of $P_e$, which is smaller than the value PC by about 30%. In the same manner, when the pressure P of the work rolls rises to the value of $P_c$, the target thickness h can be achieved to the minimum value of $h_e$, which is much smaller than the value of $h_c$. In conclusion, the inventive electric-heating rolling using pulse current to the metal strip enhances the reduction ratio considerably.

Figure 6:
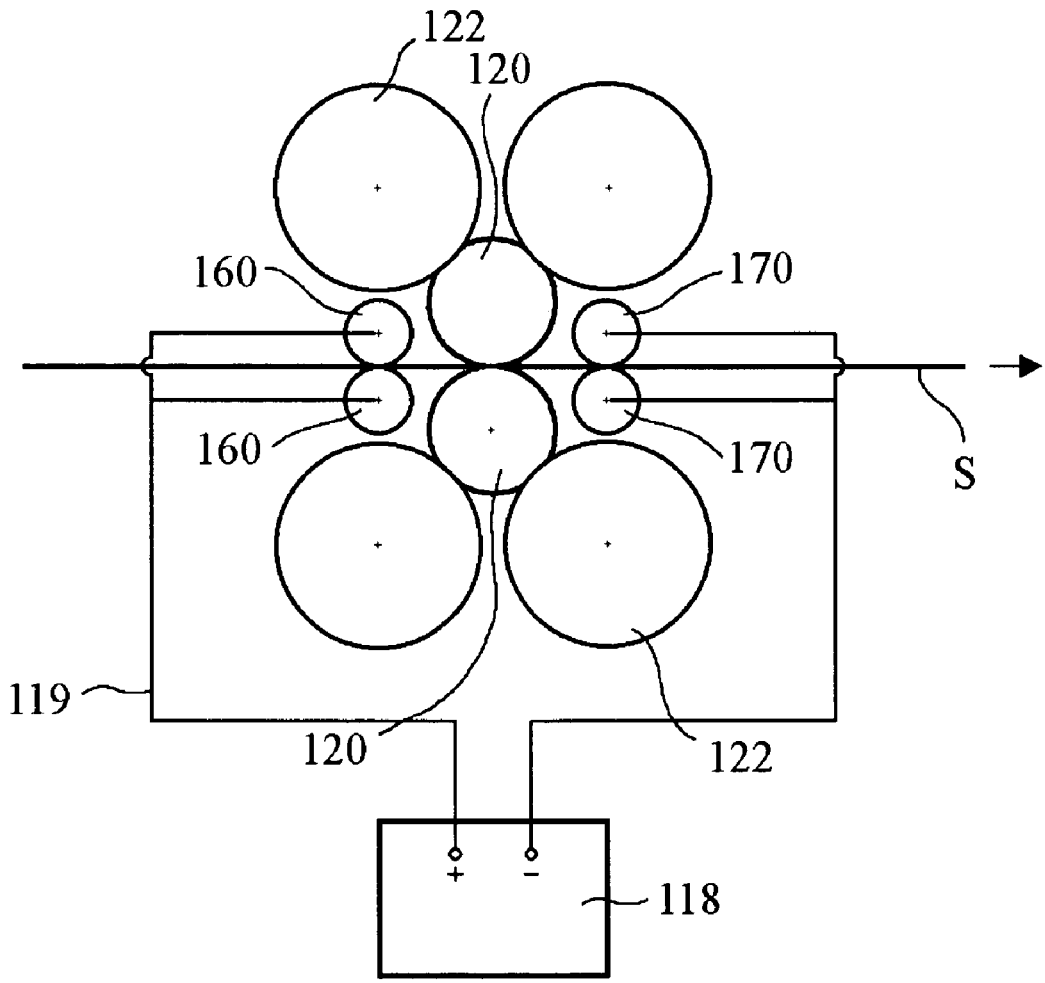
FIG. 6 shows a schematic for an inner structure of a roll stand of an electric heating type rolling device in accordance with a second embodiment of the present invention.

FIG. 6 shows a schematic for an inner structure of a roll stand of an electric heating type rolling device in accordance with a second embodiment of the present invention.

As shown in the drawing, an electric heating type rolling device in accordance with the second embodiment of the present invention includes conductive electrode means which is implemented as a pair of "upstream" electrode rolls 160 connected electrically to the positive pole of the power supply 118 and a pair of "downstream" electrode rolls 170 connected to the negative pole of the power supply 118. Each pair of electrode rolls 160 and 170 contact the upper and lower surfaces of the metal strip S, and are disposed symmetrically to each other. The electrode rolls 160 and 170 are made from a material having a high heat-resisting property and conductivity. Diameters of the electrode rolls 160 and 170 are determined such that the rolls 160 and 170 are located as close as possible to the work rolls 120 with no interference therewith, so as to minimize the decrease in surface temperature of the metal strip S fed toward the work rolls 120.

With the above structure, the power supply 118, the "upstream" electrode rolls 160, the metal strip S and the "downstream" electrode rolls 170 form a closed-circuit.

Since the electrode rolls 160 and 170 roll while contacting the running metal strip S, the wear and tear due to friction decreases considerably. Thus, the life of the electrode rolls 160 and 170 is prolonged, and the electric contact with the metal strip S is securely maintained.

In addition, in the electric heating type rolling device in accordance with the first and second embodiments, the work rolls 120 are not included in the electric circuit, so the work rolls 120 are prevented from electric corrosion.

Figure 7:
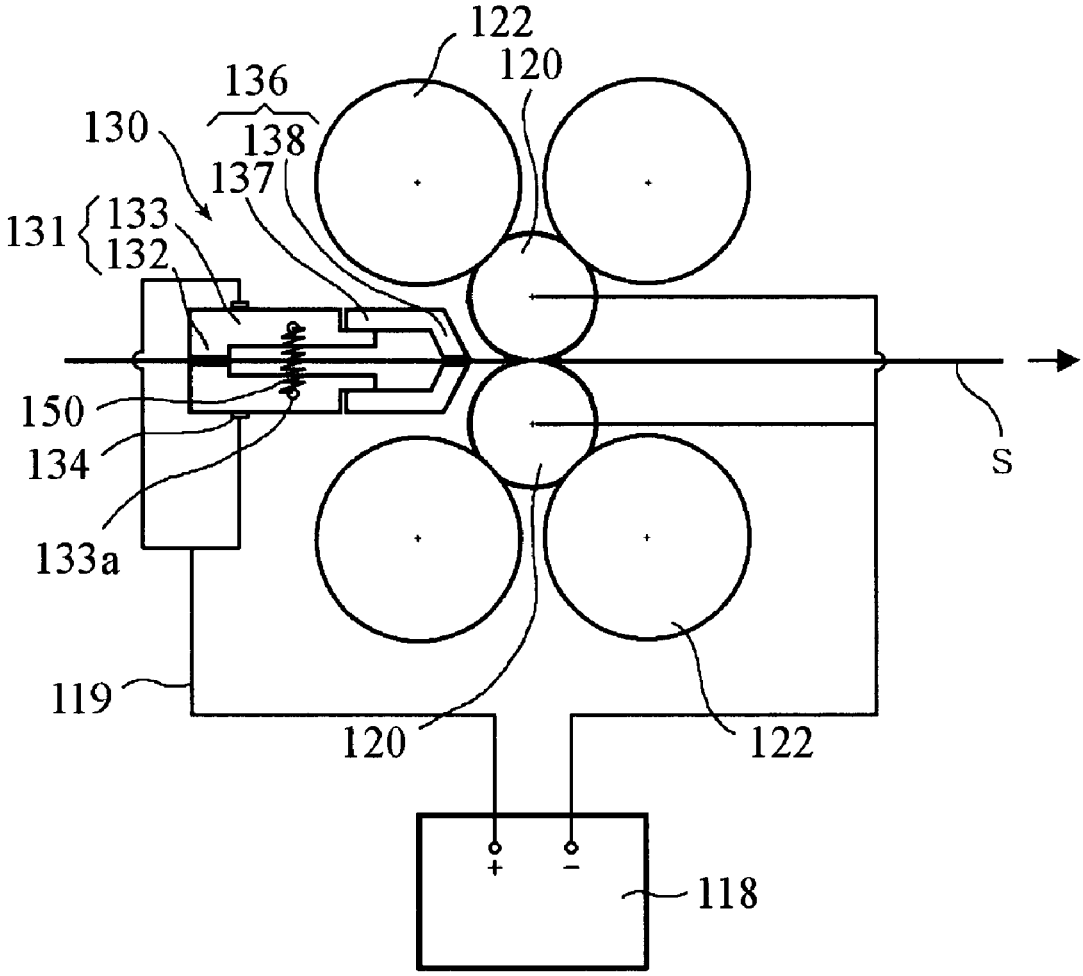
FIG. 7 shows a schematic for an inner structure of a roll stand of an electric heating type rolling device in accordance with a third embodiment of the present invention.

FIG. 7 shows schematically an inner structure of a roll stand of an electric heating type rolling device in accordance with a third embodiment of the present invention.

As shown in the drawing, an electric heating type rolling device in accordance with a third embodiment includes conductive electrode means which is implemented as a pair of "upstream" contact members 130 connected electrically to the positive pole of the power supply 118. As another conductive electrode means, the upper and lower work rolls 120 are electrically connected to the negative pole of the power supply 118.

Accordingly, the power supply 118, the "upstream" contact members 130, the metal strip S and the work rolls 120 form a closed-circuit.

Figure 8:
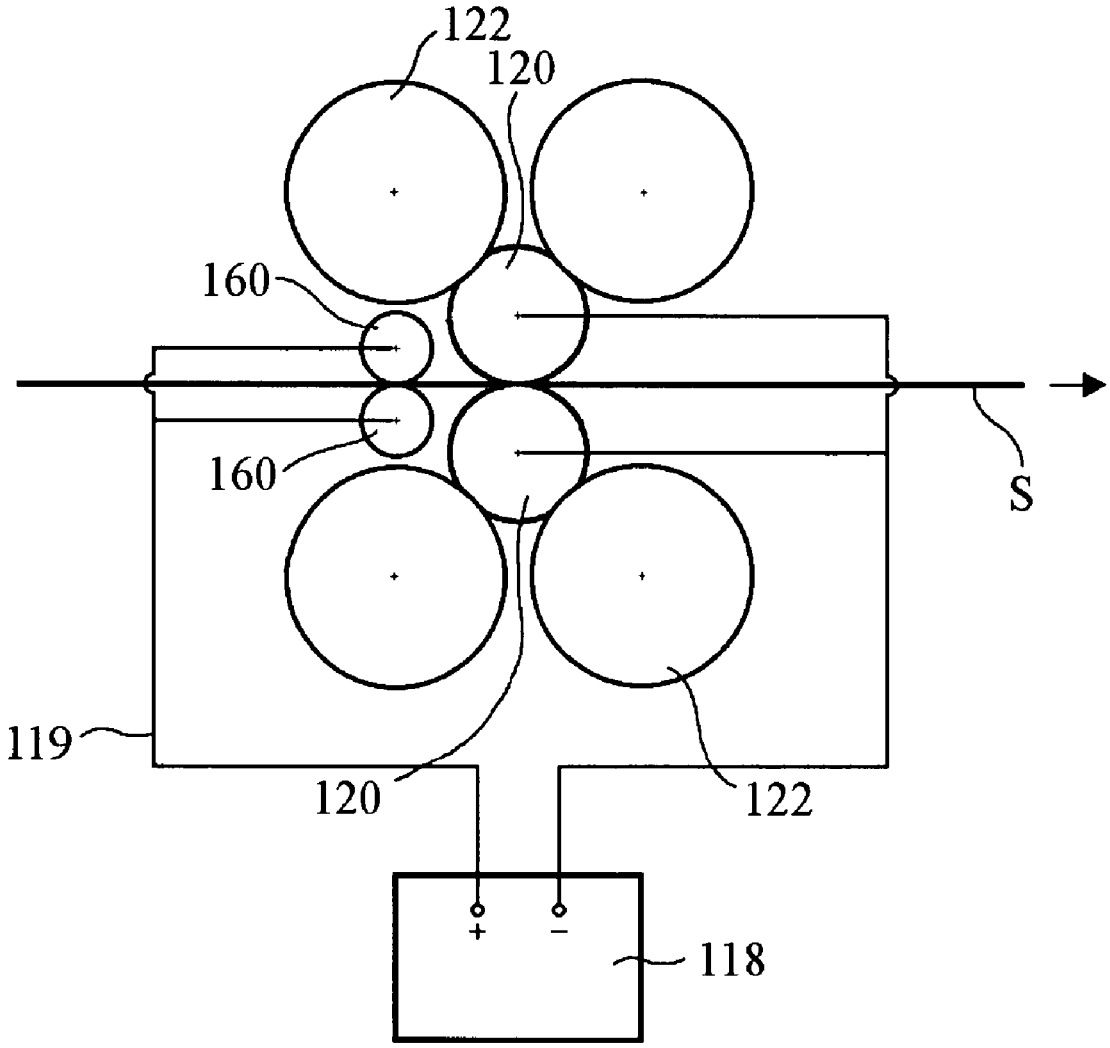
FIG. 8 shows a schematic for an inner structure of a roll stand of an electric heating type rolling device in accordance with a fourth embodiment of the present invention.

FIG. 8 shows a schematic for an inner structure of a roll stand of an electric heating type rolling device in accordance with a fourth embodiment of the present invention.

As shown in FIG. 8, an electric heating type rolling device in accordance with the fourth embodiment includes conductive electrode means which is implemented as a pair of "upstream" electrode rolls 160 connected electrically to the positive pole of the power supply 118. The upper and lower work rolls 120 are electrically connected to the negative pole of the power supply 118.

Accordingly, the power supply 118, the "upstream" electrode rolls 160, the metal strip S and the work rolls 120 form a closed-circuit.

Since the operational effect of the electric heating type rolling device in accordance with the second to fourth embodiments is same as that of the rolling device of the above first embodiment, an explanation thereof will be omitted.

It does not matter whether the positive and negative poles of the power supply 118 are connected to contact members 130 and 140, the electrode rolls 160 and 170 and the work rolls 120 reverse to the connecting method of the above embodiments.

As described above in detail, in the inventive electric heating type rolling device using a pulse current, the surface temperature of the metal strip heated by the pulse current is lower than that heated by constant current under the same current density conditions, and surface oxidization and discoloration of the metal strip are prevented. And, the work rolls, the contact members or the electrode rolls are prevented from damage by heat transfer from the metal strip. Accordingly, no cooling device for the components is necessary, thereby reducing size and manufacturing costs of the rolling device.

Also, the process described in the present invention may not require an annealing process, which is normally required in cold rolling. The present invention provides technical advantages of improving reduction ratio of the metal strip and lengthening the life of the work rolls.

While the present invention has been shown and described with respect to particular embodiments, it will be apparent to those skilled in the art that many changes and modifications may be made without departing from the spirit and scope of the invention as defined in the appended claims.

What is claimed is:

1. An electric heating type rolling device for rolling a metal strip moving in a direction, comprising:

at least one pair of work rolls for rolling said metal strip while contacting the metal strip;

a power supply for generating a pulse current; and first and second conductive electrode means which are electrically connected to said power supply for applying said pulse current to said metal strip, the first conductive electrode means being disposed in a location before said metal strip passes through said work rolls, and the second conductive electrode means being disposed opposite to the first conductive electrode means in a location after said metal strip has been rolled by said work rolls and passed thereby, wherein said first and second conductive electrode means respectively consist of a pair of plate-shaped contact members which are disposed contactingly above and below said metal strip, each said contact member including a first contact portion contacting said metal strip, a second contact portion contacting said metal strip at a position closer to said work rolls than said first contact portion, and a flat portion for connecting said first contact portion and said second contact portion while being spaced apart from said metal strip.

2. The electric heating type rolling device of claim 1, wherein said second contact portion is forked into several pieces along the transverse direction of said metal strip.

3. The electric heating type rolling device of claim 1, wherein said contact members are provided with an elastic member for biasing said second contact portion toward said metal strip to contact said metal strip with no gap.

4. An electric heating type wiling device for rolling a metal strip moving in a direction, comprising:

at least one pair of work rolls for rolling said metal strip while contacting said metal strip;

a power supply for generating a pulse current; and a conductive electrode means which is disposed in a location before said metal strip passes through said work rolls, wherein said work rolls and said conductive electrode means are electrically connected to said power supply for applying the pulse current to said metal strip, and wherein said conductive electrode means consists of a pair of plate-shaped contact members which are disposed contactingly above and below said metal strip, each said contact member including a first contact portion contacting said metal strip, a second contact portion contacting said metal strip at a position closer to said work rolls than said first contact portion, and a flat portion for connecting said first contact portion and said second contact portion while being spaced apart from said metal strip.

5. The electric heating type rolling device of claim 4, wherein said second contact portion is forked into several pieces along the transverse direction of said metal strip.

6. The electric heating type rolling device of claim 4, wherein said contact members are provided with an elastic member for biasing said second contact portion toward said metal strip to contact said metal strip with no gap.

* * * * *